United States Patent [19]

Russell

[11] Patent Number: 4,516,631

[45] Date of Patent: May 14, 1985

[54] NOZZLE COOLED BY HEAT PIPE MEANS

[75] Inventor: Cornelius R. Russell, Goshen, Conn.

[73] Assignee: Combustion Engineering, Inc., Windsor, Conn.

[21] Appl. No.: 564,662

[22] Filed: Dec. 23, 1983

Related U.S. Application Data

[63] Continuation of Ser. No. 318,247, Nov. 4, 1981, abandoned.

[51] Int. Cl.[3] ..... F28D 15/00

[52] U.S. Cl. ..... 165/47; 165/104.26; 165/104.21

[58] Field of Search ..... 165/47, 104.21, 104.26

[56] References Cited

U.S. PATENT DOCUMENTS

| | | | |
|---|---|---|---|
| 3,537,515 | 11/1970 | Byrd | 165/104.26 |
| 3,714,981 | 2/1973 | Noren | 165/47 |
| 3,719,051 | 3/1973 | Malaker | 165/104.26 |
| 3,749,163 | 7/1973 | Waters | 165/104.26 |
| 3,789,920 | 2/1974 | Low et al. | 165/104.26 |
| 3,803,688 | 4/1974 | Peck | 165/104.26 |

FOREIGN PATENT DOCUMENTS

| | | | |
|---|---|---|---|
| 370786 | 4/1932 | United Kingdom | 165/104.19 |

*Primary Examiner*—Albert W. Davis, Jr.
*Attorney, Agent, or Firm*—Arthur E. Fournier, Jr.

[57] ABSTRACT

A tubular member (40, 40') which has heat pipe cooling means (48, 48') cooperatively associated therewith and which is particularly suited for use in the manner of a nozzle for purposes of effecting the introduction of fuel, air, etc. into a substantially closed area 12 in which combustion takes place. The subject tubular member, i.e., nozzle, (40, 40') is suitably supported relative to the aforesaid combustion area (12) such that one end (30, 30') of the former (40, 40') communicates with the interior of the combustion area (12) and the other end (32, 32') thereof communicates with the exterior of the combustion area (12). Heat pipe means (48, 48') having an evaporator, i.e., hot, end and a condenser, i.e., cold, end is suitably supported in surrounding relation to the tubular member (40, 40') so as to be operative to effect a cooling of the latter (40, 40'). Within the heat pipe means (48, 48'), there is established a flow path along which a continuous flow of fluid occurs. In accord with this flow path, fluid in the form of a liquid flows through capillary action from the condenser end to the evaporator end of the heat pipe means (48, 48'). At the evaporator end of the heat pipe means (48, 48'), the liquid absorbs sufficient heat from the combustion area (12) that it vaporizes. As a vapor, the fluid then flows back from the evaporator end to the condenser end of the heat pipe means (48, 48'), where it is cooled and condenses. Thereafter, as a liquid the fluid once again commences its travel along the flow path provided therefor within the heat pipe means (48, 48').

3 Claims, 5 Drawing Figures

NOZZLE COOLED BY HEAT PIPE MEANS

BACKGROUND OF THE INVENTION

This is a continuation of application Ser. No. 318,247, filed Nov. 4, 1981, now abandoned.

This invention relates to nozzles, and more specifically to nozzles of the type that are operative for providing fuel, air, etc. into the interior of a boiler or some other similar form of apparatus, and wherein a requirement exists that a cooling of the nozzle be effected.

In those applications wherein a nozzle is employed for purposes of supplying fuel, or air, etc. to the interior of a boiler or other similar form of apparatus, it is customary to have the nozzle extend through a penetration which is provided for this purpose at a preselected location in a given one of the wall members that collectively define the combustion area of the boiler or other like apparatus. Further, the orientation of the nozzle is commonly such that the nozzle lies in a plane that extends substantially horizontally. Moreover, when the nozzle is so positioned it may either bear a substantially flush fit with the inside surface of the respective one of the wall members of the boiler that is penetrated thereby or else it may project inwardly beyond the inside surface of the respective one of the boiler wall members. Lastly, note is taken here of the fact that the inner surface of the boiler wall members may be covered with some suitable form of refractory material such that the flush fit of the nozzle is relative to the refractory material that covers the boiler wall member rather than relative to the boiler wall member per se.

After extended periods of use of the boiler, such nozzles have been known to exhibit signs of damage. Moreover, the cause of such damage is known to be attributable to exposure to the very high temperature to which the outlet, i.e., exit, end of the nozzle is subjected. The susceptibility of the nozzle to incur such damage appears to be particularly prevalent in the case of those applications wherein the nozzle projects inwardly beyond the inside surface of the boiler wall members as well as in those applications wherein the boiler wall members are covered with a refractory material. As regards the latter type of application, the refractory material after a period of time wears away such that the outlet end of the nozzle if it had not originally been exposed, i.e., originally bore a flush fit relative to the refractory covered boiler wall member, now becomes exposed by virtue of the existence of a reduced thickness of refractory material covering the boiler wall member.

The nature of the damage incurred by the nozzle commonly is in the form of some type of deformation of the exit end of the nozzle. More specifically, the exit end of the nozzle becomes deformed such that the desired flow of fuel, or air, etc. through the nozzle is impaired. This in turn adversely affects not only the operation of the nozzle itself, but also the functioning of the boiler generally. Ultimately, this gives rise to a need to replace the damaged nozzle. However, to do so requires that the boiler be shutdown, i.e., be unusable for a period of time.

There have been various attempts made at extending the operating life of these nozzles. For example, one approach that has been tried is that of fabricating the nozzles of material which has a higher melting temperature. However, in addition to being in general relatively more costly to provide, the performance achievable therewith has proven to be less than desired. Accordingly, another approach that has been pursued is that of attempting to effect a cooling of the nozzle. More specifically, it has been known to employ nozzles which are cooled with water. In accord therewith, water is circulated in an annulus that surrounds the nozzle. Such water cooled nozzles, though, have not been free of failure. In this regard, the most common cause of failure of water cooled nozzles has been found to be overheating. In addition, however, failures of water cooled nozzles have also been known to occur that are believed to have been caused by intergranular/transgranular attack by a polythionic acid from the outside to the inside. Such failure attributable to acid attack of the water cooled nozzle is deemed to be capable of being obviated through the judicious selection of materials that are characterized by the fact that they are known not to be subject to acid corrosion.

With reference to the subject of the overheating of water cooled nozzles, such overheating is known to be due to several causes. For example, an insufficient supply of cooling water imputable to weld failure is known to be a cause of such overheating. Also, overheating is known to have been caused by the presence in the annulus through which the cooling water flows of so-called "dead" or quiet zones. The latter are zones in the annulus through which there is an insufficient flow of water from the standpoint of that needed to effect a cooling of the nozzle. Yet another reason for such overheating has been the occurrence of a buildup in the annulus through which the cooling water flows of scale and particles that are deposited out from the cooling water. A buildup of this nature ultimately can have the effect of interfering with the flow of coolant, i.e., cooling water, such that hot spots become created which subsequently leads to overheating and finally to a failure of the nozzle. Lastly, in those instances wherein a multiplicity of nozzles are cooled through the use of a common cooling water distribution system an unequal distribution of the flow of cooling water as between each of the nozzles can give rise to overheating of a nozzle because of an insufficient flow of cooling water thereto.

The problem of overheating associated with the use of water cooled nozzles has been addressed, but unfortunately to date has not been successfully resolved. Thus, for instance in an endeavor to eliminate weld failures, improved techniques of welding have been relied upon in the fabrication of water cooled nozzles. Also, to avoid "dead" or quiet zones, use has been made of water baffles to better direct the flow of the cooling water so that such zones are eliminated. Moreover, filters have been installed in the cooling water supply to prevent or minimize the buildup of scale and the particles that might otherwise act to block cooling water flow and thus cause hot spots that subsequently lead to overheating and ultimate failure of nozzles. Further, in the case of multiple nozzles that are served by a common cooling water distribution system, changes have been effected in the distribution system to ensure that a sufficient flow of cooling water is received by each nozzle.

Notwithstanding all of the aforedescribed efforts, the performance sought from water cooled nozzles has not been attainable to date therewith. Consequently, a need has been evidenced for a new and improved form of cooling means that is operable for purposes of effecting a cooling of nozzles, and in particular nozzles of the type that are intended to be employed to accomplish the introduction of fuel, or air, etc. into the interior of a substantially closed area in which combustion takes place. Moreover, such a new and improved form of cooling means for nozzles desirably should be advantageously characterized by the fact that problems associated with water-borne chemical deposits, particulates and scales are avoided therewith; that the failure of a nozzle does not occasion the venting of cooling water into the area wherein combustion is taking place such that the removal of slag from the combustion area in adversely affected therewith; that minimal usage is required therewith of filters, pumps, manifolds, valves, etc.; that hot spots, which if they do occur, can give rise to a nozzle failure, are inherently precluded from occurring therewith; and that no on-off mode exists therewith which could in the event of a power failure produce component failure, etc.

It is, therefore, an object of the present invention to provide a nozzle that is equipped with means operative for effecting a cooling of the nozzle.

It is another object of the present invention to provide such a nozzle wherein the means for effecting the cooling thereof comprises heat pipe means.

It is still another object of the present invention to provide such a nozzle equipped with heat pipe cooling means which avoids the problems that water-borne chemical deposits, particulates and scaling give rise to.

A further object of the present invention is to provide such a nozzle equipped with heat pipe cooling means which is operative as a self-contained unit thus eliminating the requirement for employing externally valves, filters, manifolds, pumps, etc.

A still further object of the present invention is to provide such a nozzle equipped with heat pipe cooling means that inherently minimizes the possibility for the development of hot spots.

Yet another object of the present invention is to provide such a nozzle equipped with heat pipe cooling means that does not make use of an on-off mode which in the event of a power loss could cause component failure, etc.

Yet still another object of the present invention is to provide such a nozzle equipped with heat pipe cooling means that is advantageously characterized in that it is relatively inexpensive to produce, yet despite being relatively simple in construction is capable of providing reliable operation.

SUMMARY OF THE INVENTION

In accordance with the present invention, there is provided a nozzle preferably of substantially cylindrical configuration which has heat pipe means cooperatively associated therewith, and which is particularly suited for use for purposes of effecting the introduction of fuel, or air, etc. into some form of a combustion chamber. The subject nozzle is suitably supported relative to the combustion chamber such that the former has one end thereof which communicates with the interior of the combustion chamber and the other end which communicates with the exterior thereof. The heat pipe means is suitably supported in surrounding relation to the nozzle so as to be operative to effect a cooling of the latter. The subject heat pipe means includes a substantially cylindrical member positioned in concentric relation to the cylindrically configured nozzle such that a chamber-like area, i.e., region, is established within the cylindrical member and to the exterior of the nozzle. There is positioned within this chamber-like area divider means operative to divide the chamber-like area into at least a first compartment and a second compartment. At least one of the first and second compartments is filled with porous felt-like metal material that possesses the functional attributes of a wick. Further, within the chamber-like area there is provided a suitable amount of coolant. One end of the cylindrical member of the heat pipe means is designed to be operative as an evaporator, i.e., hot, end, while the other end thereof is designed to be operative as a condenser, i.e., cold, end. Also, a suitable heat dissipating means is provided externally of the cylindrical member at the condenser end of the heat pipe means. A flow path is established within the cylindrical member of the heat pipe means along which a continuous flow of the coolant takes place. In accord with this flow path, coolant in the form of a liquid flows through capillary action from the condenser end to the evaporator end of the cylindrical member of the heat pipe means. At the evaporator end of the cylindrical member of the heat pipe means, the liquid absorbs sufficient heat from the combustion taking place within the combustion chamber that the liquid vaporizes. As a vapor, the coolant then flows back from the evaporator end to the condenser end of the cylindrical member of the heat pipe means, where it is cooled through the action of the heat dissipating means and condenses. Thereafter, once again in the form of a liquid the coolant recommences its travel along the flow path established therefor within the cylindrical member of the heat pipe means.

DESCRIPTION OF A PREFERRED EMBODIMENT

Figure 1:
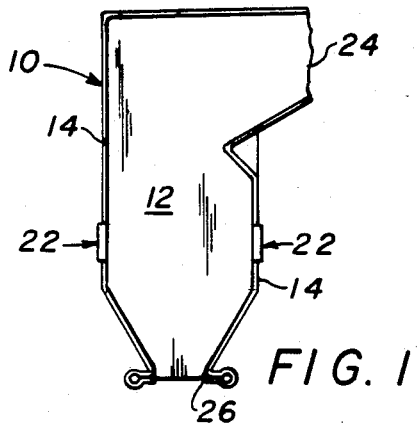
FIG. 1 is a schematic representation of an apparatus embodying a combustion chamber of the type with which a nozzle equipped with heat pipe cooling means constructed in accordance with the present invention is intended to be employed.

Referring now to the drawing and more specifically to FIG. 1 thereof, there is depicted therein a schematic representation of an apparatus, generally designated by reference numeral 10, that embodies a combustion chamber 12 of the type with which the subject matter of the present invention is particularly suited to be utilized. Insofar as the apparatus 10 is concerned, the nature of the construction thereof is only indirectly related to the subject matter of the present invention. Accordingly, it is not deemed necessary to set forth herein a detailed description of the nature of the construciton of the apparatus 10. Rather, the brief description thereof which follows hereinafter is deemed to be sufficient for purposes of obtaining an understanding of the nature of the present invention. Finally, note is to be taken here of the fact that the apparatus 10, as illustrated in FIG. 1, is intended simply to be representative of those various forms of apparatus which embody a combustion chamber in which combustion occurs, and wherein the introduction of the fuel, or air, etc., which is burned in this combustion chamber, is effected by nozzle means. In this regard, by way of exemplification but not limitation, the apparatus 10 is intended to encompass coal gasification apparatus, steam generation apparatus, etc.

Figure 2:
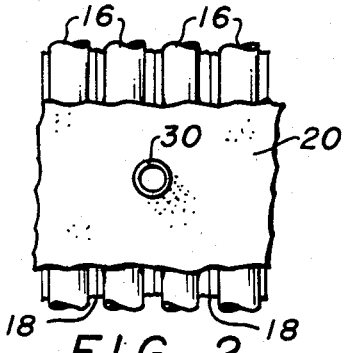
FIG. 2 is a side elevational view of a portion of the interior wall surface of the apparatus of FIG. 1 illustrating the manner in which a penetration thereof is effected by a nozzle equipped with heat pipe cooling means constructed in accordance with the present invention.

With further reference to FIG. 1 and the apparatus 10 depicted therein, the latter for purposes of acquiring an understanding of the nature of the present invention includes a plurality of suitably interconnected wall members 14, which collectively enclose laterally the previously mentioned combustion chamber 12, i.e., that area of the apparatus 10 in which combustion takes place. In accord with one form of construction that the apparatus 10 may embody, each of the wall members 14, as best understood with reference to FIG. 2, consists of a multiplicity of vertically extending tubes 16. The latter tubes 16 as illustrated in FIG. 2, further are suitably interconnected one with another by means of coplanar metal web portions 18. Thus, taken together the tubes 16 and the web portions 18 define the boundary of the combustion chamber 12. To this end, the nature of the construction of a combustion chamber 12 is that of an all-metal, gas-tight enclosure. As illustrated in FIG. 2, the tubes 16 and web portions 18 may be suitably covered with a layer 20 of conventional type refractory material of predetermined thickness.

Turning again to a consideration of FIG. 1, in a manner to which further reference will be had hereinafter, the apparatus 10 embodies means, generally designated in FIG. 1 of the drawing by the reference numeral 22, through which there is effected the introduction into the combustion chamber 12 of the fuel, air, etc. that are required for combustion. In conclusion, simply stated the mode of operation of the apparatus 10 is such that the gaseous products of the combustion taking place within the combustion chamber 12 flow upwardly towards the portion of the apparatus 10 that is denoted by reference numeral 24 in FIG. 1. On the other hand, the solid products of the combustion taking place within the combustion chamber 12 exit from the apparatus 10 through that portion thereof which is identified by means of the reference numeral 26 in FIG. 1.

Figure 3:
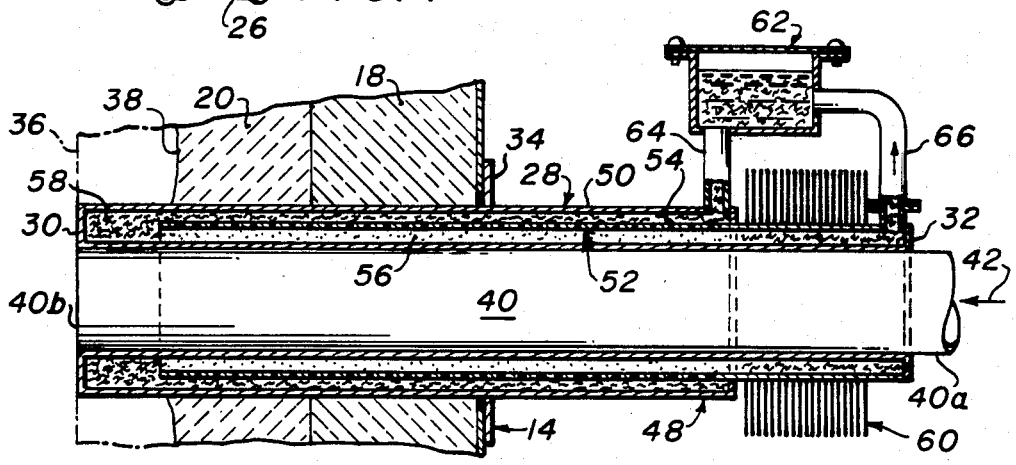
FIG. 3 is a cross-sectional view of a nozzle equipped with a first embodiment of heat pipe cooling means constructed in accordance with the present invention illustrated in the installed condition.

There will now be set forth a description of one embodiment of a nozzle assembly that is provided with heat pipe cooling means constructed in accordance with the present invention. For this purpose, reference will be had in particular to FIG. 3 of the drawing. Thus, in the latter Figure there is illustrated a nozzle assembly, generally designated therein by reference numeral 28. In the interest of maintaining clarity of illustration in the drawing, only one such nozzle assembly 28 is depicted in FIG. 3. However, it is to be understood that in accord with normal industry practice, the means 22, shown in FIG. 1, with which the apparatus 10 is provided would commonly consist of a plurality of such nozzle assemblies 28. Continuing with a description of the nozzle assembly 28 of FIG. 3, the assembly 28 is intended to be operative for purposes of effecting the introduction of fuel, or air, etc. into the combustion chamber 12 of the apparatus 10. To this end, as is best understood with reference to FIG. 2 of the drawing, the nozzle assembly 28 has one end thereof, seen at 30 in FIG. 2, which projects through, i.e., penetrates a given one of the wall members 14 of the apparatus 10 such that the nozzle assembly 28 has one end thereof, i.e., the end denoted by the reference numeral 30, which communicates with the interior of the combustion chamber 12 and the other end thereof which is located externally of the combustion chamber 12 so as to be readily accessible for connection to a suitable source of supply of fuel, or air, etc.

Insofar as the above is concerned, it should furthermore be understood that the end of the nozzle assembly 28 which is denoted by the reference numeral 30 in FIG. 2 may make either a flush fit with or may project outwardly of the exterior surface of the layer 20 of refractory material, depending on the nature of the particular application in which the nozzle assembly 28 is being utilized. In addition, there exists applications in which the end 30 of the nozzle assembly 28 originally is located such as to make a flush fit with the exterior surface of the layer 20 of refractory material, but as the latter material becomes worn away, i.e., takes on a reduced thickness, the end 30 of the nozzle assembly 28 assumes a position wherein it projects outwardly of the layer 20 of the refractory material to a measureable extent into the interior of the combustion chamber 12 of the apparatus 10. Accordingly, the present invention is not to be taken as being limited to a nozzle assembly, e.g., the nozzle assembly 28 of FIG. 3 or the as of yet unidentified nozzle assembly of FIG. 4, which either makes a flush fit with the exterior surface of the respective wall member 14 that is penetrated thereby, or projects outwardly thereof, but rather should be viewed as encompassing both of these forms of construction as well as that wherein the nozzle assembly originally makes a flush fit with the refractory covered wall member 14 but as the refractory wears away, the nozzle assembly assumes a relationship relative to the wall member 14 wherein the nozzle assembly projects outwardly thereof.

Referring still to FIG. 3 of the drawing, the nozzle assembly 28 is depicted therein in the installed condition relative to the wall member 14. More specifically, as illustrated therein, the nozzle assembly 28 projects through, i.e., penetrates, the wall member 14 such that the end 30 of the nozzle assembly 28 communicates with the interior of the combustion chamber 12, whereas the other end thereof, i.e., that denoted by the reference numeral 32 in FIG. 3, is located externally of the wall member 14 so as to be readily accessible for connection to a suitable source of supply of fuel, or air, etc. To this end, the nozzle assembly 28 in accord with the embodiment thereof illustrated in FIG. 3 has a portion thereof which extends through one of the web portions 18 and the layer 20 of refractory material, which collectively constitute the wall member 14 at the location thereof whereat a penetration thereof is had by the nozzle assembly 28. In addition, as depicted in FIG. 3 the nozzle assembly 28 is also made to pass through a metal sheet-like member 34, the latter being suitably positioned in juxtaposed relation to the exterior surface of the web portion 18. In accord with the illustration of FIG. 3, the layer 20 of refractory material is shown as having been worn away from an original thickness thereof denoted in FIG. 3 by means of the phantom line 36 to the solid line position thereof denoted in FIG. 3 by reference numeral 38. Note should be taken here of the fact that in accord with the illustration of FIG. 3 the original thickness of the layer 20 of the refractory material was suitably preselected such that the end 30 of the nozzle assembly 28 was made to have a flush fit with the exterior surface of the layer 20.

Continuing with a description of the structure embodied by the nozzle assembly 28, the latter includes a suitably dimensioned, cylindrically-shaped, tube-like member, referred to hereinafter as the tube 40. The latter tube 40 functions as the means by which fuel, or air, etc. is introduced from the exterior of to the interior of the combustion chamber 12. The direction of flow of the substance through the tube 40 is denoted by means of the arrow 42 in FIG. 3. Although not shown in FIG. 3 in the interest of maintaining clarity of illustration therein, it is to be understood that the end 40*a* of the tube 40 is suitably connected to a source of supply (not shown) of the particular substance which it is desired to have introduced into the interior of the combustion chamber 12 by means of the tube 40.

In accord with the present invention, the nozzle assembly 28 further includes heat pipe cooling means, generally desingated in FIG. 3 by the reference numeral 48. Moreover, in accord with the form thereof which is shown in FIG. 3, the heat pipe cooling means 48 includes a cylindrical member 50 which is suitably secured through the use of any conventional form of securing means (not shown) in mounted, surrounding relation to the tube 40 along at least a portion of the length of the latter. More specifically, the cylindrical member 50 is made to extend in surrounding relation to the tube 40 from at least the end 40*b* of the latter to at least a point along the length thereof, which is located externally of the wall member 14 when the nozzle assembly 28 occupies the installed position thereof relative to the wall member 14. i.e., the nozzle assembly 28 bears the same relationship to the wall member 14 as that shown in FIG. 3.

The cylindrical member 50 of the heat pipe cooling means 48 which is positioned in concentric relation to at least a portion of the length of the cylindrically configured tube, i.e., nozzle, 40 is of double-wall construction such that a chamber-like area, i.e., region, is formed therewithin. A divider means 52 is suitably supportdd through the use of any conventional form of supporting means (not shown) within the aforesaid chamber-like area such that the latter is divided thereby into a first compartment 54 and a second compartment 56. In accord with the form of the invention which is illustrated in FIG. 3 of the drawing, the divider means 52 comprises a cylindrically configured metal member which preferably is perforated along at least a portion of the length thereof for a purpose that is yet to be described.

One of the first and second compartments 54 and 56, respectively, is provided therewithin for at least a portion of the length thereof with a material that has the functional attributes of a wick, i.e., is capable of functioning in the manner of a wick. There are known to exist a number of materials that are suitable for use for this purpose. In this regard, the selection of a particular material for use in a given application should be based upon a consideration of among other things the following: the noncorrosiveness of the material relative to the coolant with which it is to be employed, and the temperature to which the material is to be subjected. To this end, in accord with the preferred form of the invention the material comprises a felt-like metal material. Moreover, the latter material also possesses the characteristic of being porous. The term porous as used herein is intended to refer to the fact that the material is such that coolant will pass therethrough by means of capillary action.

The placement of the material 58 is determined based on a consideration of the surface which it is desired to cool. For example, when the primary concern is the cooling of the exterior surface of the nozzle assembly 28 including the tip portion 30 thereof, the material 58 is positioned within the first compartment 54. Namely, the material 58 is positioned within the heat pipe cooling means 48 in the manner illustrated in FIG. 3. On the other hand, if it is the interior surface of the tube 40 including the tip portion 30 thereof that is to be cooled the material 58 would be positioned within the second compartment 56. The method of placement of the material 58 within the heat pipe cooling means 48 is not depicted in the drawing inasmuch as it is deemed to be readily understandable without reference to an illustration thereof. That is, such an illustration is not deemed essential for purposes of acquiring an understanding of the subject matter of the present invention. Lastly, when it is desired to effect a cooling of both the exterior surface of the nozzle assembly 28 and the interior surface of the tube 40, a form of construction is employed such as that depicted in FIG. 4 and to which further reference will be had hereinafter.

For a purpose yet to be described, the heat pipe cooling means 48 further includes heat dissipating means, generally designated in FIG. 3 by means of the numeral 60. The heat dissipating means 60 may take various forms. For example, the heat dissipating means 60 may take a form wherein the mode of operation thereof is such that the heat dissipation effected thereby is accomplished by means of the radiative action of one or more passive heat transfer elements. To this end, reference is had to FIG. 3 of the drawing wherein the heat dissipating means 60 depicted therein is suitably supported on the exterior surface of the cylindrical member 50 in mounted, surrounding relation thereto through the use of any suitable conventional form of supporting means (not shown). Furthermore, in accord with the illustration of the nozzle assembly 28 that appears in FIG. 3, the heat dissipating means 60 comprises a member consisting of a multiplicity of fin-like segments that extend outwardly in a radial direction from the exterior surface of the cylindrical member 50. However, the heat dissipating means 60 could equally well without departing from the essence of the present invention take the form of an expanded metal passive heat transfer element (not shown).

Continuing, instead though of accomplishing the heat dissipation through the radiative action of passive heat transfer elements, the heat dissipation could also without departing from the essence of the present invention be effected through the use of an active coolant loop (not shown) suitably provided in encircling relation to the exterior surface of the cylindrical member 50 adjacent the end of the nozzle assembly 28 denoted by the reference numeral 32 in FIG. 3. Further, for this purpose there could be circulated in the aforesaid coolant loop which is intended to be representative of an active version of the heat dissipating means 60, any suitable type of coolant, e.g., water.

Figure 4:
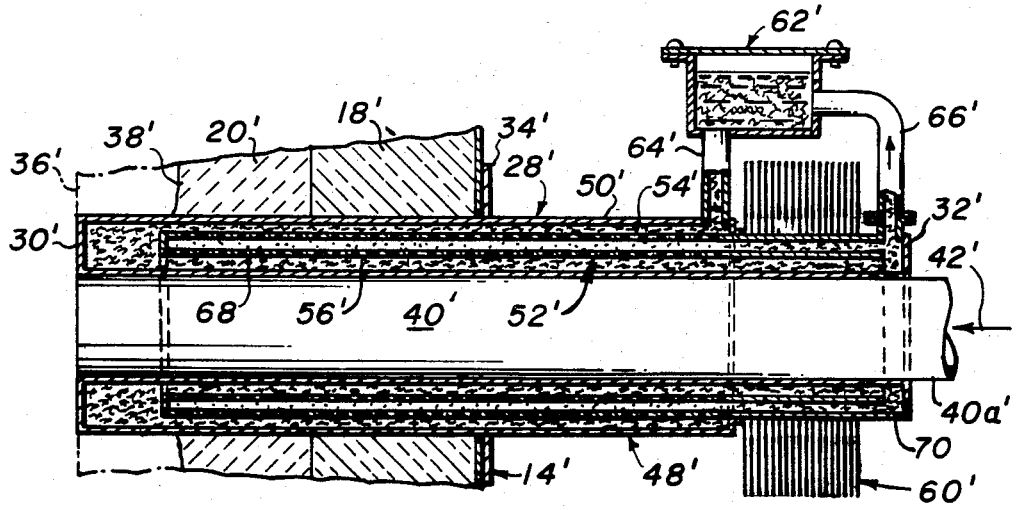
FIG. 4 is a cross-sectional view of a nozzle equipped with a second embodiment of heat pipe cooling means constructed in accordance with the present invention illustrated in the installed condition.
Figure 5:
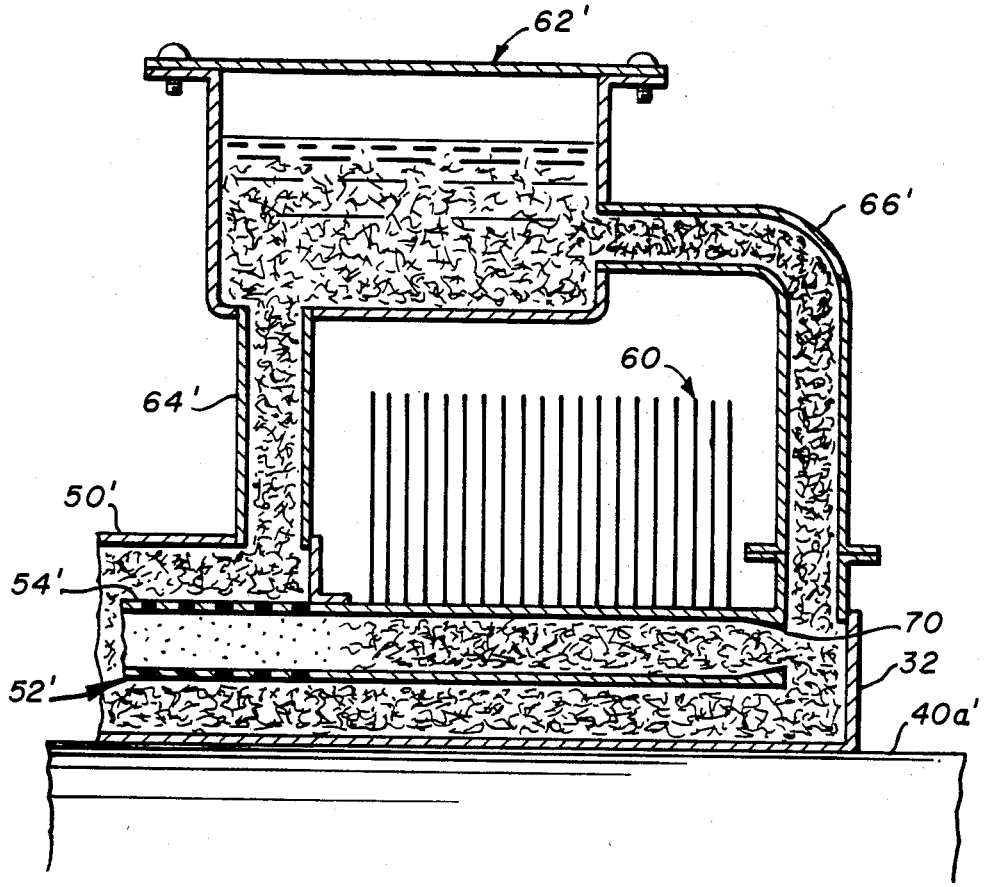
FIG. 5 is a cross-sectional view on an enlarged scale of a portion of the nozzle equipped with the second embodiment of a heat pipe cooling means shown in FIG. 4, illustrating the nature of the construction of the condenser end thereof.

With further reference to FIG. 3, the chamber-like area with which the cylindrical member 50 is provided contains a suitable amount of coolant fluid. The latter coolant fluid as described more fully hereinafter flows along a fluid flow path with which the heat pipe cooling means 48 is suitably provided. In addition, in accord with the mode of construction of the embodiment of the invention that is illustrated in FIG. 3 of the drawing, there is included within the fluid flow path with which the heat pipe cooling means 48 is provided a reservoir, the latter being denoted in FIG. 3 by the reference numeral 62. Moreover, the reservoir 62 contains a suitable supply of coolant fluid. As will be described more fully hereinafter in the course of setting forth a description of the mode of operation of the nozzle assembly of FIG. 3, the coolant fluid flows from the reservoir 62 by means of outlet pipe 64 into the cylindrical member 50, and more particularly to and along the length of the first compartment 54. From the first compartment 54, the coolant fluid enters the second compartment 56 and flows along the length thereof. Thereafter, the coolant fluid leaves the second compartment 56 and enters the reservoir 62 by means of the inlet pipe 66. Finally, as will be further discussed hereinafter in connection with the description of the structure that is depicted in FIGS. 4 and 5, the reservoir 62 may be provided with a passive pump means (not shown) operative to assist in the recirculation of the coolant fluid along the fluid flow path with which the heat pipe cooling means 48 is provided.

A description will now be had of the mode of operation of the nozzle assembly 28 equipped with the heat pipe cooling means 48, the latter being constructed as illustrated in FIG. 3. In accord therewith, one end of the heat pipe cooling means 48, i.e., that end thereof which is located at the end 30 of the nozzle assembly 28, is designed to function as the evaporator, i.e., hot, end of the heat pipe cooling means 48, whereas the other end of the heat pipe cooling means 48 is designed to function as the condenser, i.e., cold, end thereof. Thus, in accordance with the mode of operation of the nozzle assembly 28, the nature of the fluid flow path with which the heat pipe cooling means 48 is provided is such that coolant fluid, preferably consisting of water, flows from the reservoir 62, in the form of a liquid into the first compartment 54 of the cylindrical member 50. This takes place at the condenser end of the heat pipe cooling means 48. In the form of a liquid, the water then flows by means of capillary action which is induced by virtue of the wick-like attributes of the material 58 along the length of the first compartment 54 to the evaporator end of the heat pipe cooling means 48. At the evaporator end of the heat pipe cooling means 48, the liquid coolant, i.e., water, absorbs sufficient heat from the combustion taking place within the combustion chamber 12 that the water vaporizes. As a vapor, the coolant then flows back from the evaporator end of the heat pipe cooling means 48, i.e., along the length of the second compartment 56, to the condenser end of the heat pipe cooling means 48. At the condenser end of the heat pipe cooling means 48, the coolant becomes cooled and condenses. The aforementioned cooling of the coolant is effected by means of the operation of the heat dissipating means 60. Having completed its passage through the fluid flow path of the heat pipe cooling means 48, the coolant which is once again in the form of a liquid reenters the reservoir 62 from the second compartment 56 through the inlet pipe 66. The coolant as a liquid thereafter leaves the reservoir 62 through the outlet pipe 64 to recommence its travel along the flow path established therefor within the cylindrical member 50 of the heat pipe cooling means 48 whereby the coolant fluid functions to effect the cooling desired of the tube, i.e., nozzle 40.

In accord with the embodiment of the heat pipe cooling means 48 illustrated in FIG. 3, the divider member 52 is depicted as being perforated along a portion of the length thereof. The function of these perforations is to enable the coolant fluid, should it become vaporized before reaching the end 30 of the nozzle assembly 28, to pass therethrough for purposes of reaching the second compartment 56 from the first compartment 54, rather than necessitating that the vapor travel around the end of the divider member 52, if the latter were not perforated, to enter the second compartment 56 from the first compartment 54. The intent, thus, in providing the member 52 with perforations is to minimize thereby the possibility that the existence of vapor bubbles amidst the otherwise liquid coolant might serve to disadvantageously affect the flow by means of capillary action of the liquid coolant within the first compartment 54.

As depicted in FIG. 3, the nature of the construction of the heat pipe cooling means 48 is such that it includes the reservoir 62. The sole function, however, of the reservoir 62 is to provide a reservoir of coolant fluid in the event that makeup fluid should be required. That is, should a loss of coolant occur during the course of the continuous flow of the coolant along the fluid flow path that is established within the cylindrical member 50 of the heat pipe cooling means 48, the intent is that this coolant which is lost would be replaced by fluid contained in the reservoir 62,.i.e., the level of the fluid in the reservoir 62 would simply drop. The function of the reservoir 62, therefore, is not to provide a head for the coolant fluid that flows through the heat pipe cooling means 48. Accordingly, the reservoir 62 is not deemed to be essential to the operation of the heat pipe cooling means 48. Consequently, contemplated within the present invention is a nozzle assembly 28 equipped with a heat pipe cooling means that embodies the same form of construction as the heat pipe cooling means 48 that is illustrated in FIG. 3 but with the omission therefrom of the reservoir 62.

Finally, although the coolant fluid for purposes of the description of the mode of operation of the nozzle assembly 28 equipped with the heat pipe cooling means 48 constructed in accord with the illustration of FIG. 3 has been identified to be water, it is contemplated that other forms of coolant fluid could be utilized in lieu of water without departing from the essence of the present invention. To this end, the coolant fluid that is ultimately selected for employment in the nozzle assembly 28 equipped with the heat pipe cooling means 48 is determined based upon a consideration, among others, of factors such as the noncorrosiveness of the coolant fluid in terms of the materials with which it would come into contact during the course of its flow through the heat pipe cooling means, the capability of the coolant fluid to withstand the temperatures to which it will be subjected as a function of the temperature which will exist within the combustion chamber 12, the capability of the coolant fluid to effect a cooling of the tube 40 to the temperature desired, etc.

Considering next FIGS. 4 and 5 of the drawing, there is depicted therewithin another embodiment of a nozzle assembly that is equipped with a heat pipe cooling means constructed in accord with the teachings of the present invention. More specifically, the heat pipe cooling means illustrated in FIGS. 4 and 5 embodies a modified form of construction from that embodied by the heat pipe cooling means 48 shown in FIG. 3. Namely, the principal difference between the heat pipe cooling means 48 of FIG. 3 and the heat pipe cooling means depicted in FIGS. 4 and 5 resides in the nature of the divider means with which each of the two heat pipe cooling means is provided. Accordingly, for ease of understanding, the structure embodied in the nozzle assembly equipped with heat pipe cooling means in accord with the present invention which is shown in FIGS. 4 and 5 that finds correspondence in the structure of the nozzle assembly 28 equipped with a heat pipe cooling means 48 constructed in accord with the illustration of FIG. 3 has been designated in both FIG. 3 and FIGS. 4 and 5 through the use of the same reference numeral, but with the addition of a prime to the reference numeral in the case of the structure appearing in FIGS. 4 and 5.

Therefore, with further reference in particular to FIG. 4 of the drawing, there is depicted therein a nozzle assembly 28′ equipped with a heat pipe cooling means 48′, the latter being designed to be operative to effect a cooling to the extent desired of the tube 40′ of the nozzle assembly 28′. Like the nozzle assembly 28 of FIG. 3, the nozzle assembly 28′ of FIGS. 4 and 5 is depicted as being in an installed condition relative to the wall member 14′. That is, the nozzle assembly 28′ penetrates a web portion 18′, which with the layer 20′ of refractory material combines to comprise the wall member 14′. The layer 20′ of refractory material through the use of the solid line denoted by the reference numeral 38′ in FIG. 4 is depicted therein as having been worn away. However, the original thickness of the layer 20′ is also illustrated in FIG. 4 through the use therein of the phantom line that is identified by means of the reference numeral 36′. Lastly, there is provided in juxtaposed relation to the exterior surface of the web portion 18′ a sheet-like metal member 34′ through which the nozzle assembly 28′ additionally passes.

The tube 40′ is intended to be operative to effect the introduction of fuel, or air, etc. into the combustion chamber 12. The direction of flow through the tube 40′ of the substance that is selected to be introduced therethrough into the combustion chamber 12 is denoted by the arrow 42′. Although not shown in FIGS. 4 and 5 in the interest of maintaining clarity of illustration therein, the tube 40′ has the end 40*a*′ thereof suitably connected in fluid flow relation to a suitable source of supply of the particular substance that it is desired to have flow through the tube 40′ into the combustion chamber 12.

Referring again to FIGS. 4 and 5, suitably supported through the use of any suitable conventional form of support means (not shown) in mounted, surrounding relation to the tube 40′ is the heat pipe cooling means 48′. The heat pipe cooling means 48′ has one end thereof, i.e., the end thereof that is adjacent to the end 30′ of the nozzle assembly 28′, which is operative as an evaporator, i.e., hot end, and the other end thereof which is operative as a condenser, i.e., cold end. Moreover, the heat pipe cooling means 48′ includes a cylindrical member 50′ which is of double wall construction such that there exists between the walls thereof a suitably dimensioned chamber-like area, i.e., region.

A divider means 52′ is suitably supported within the chamber-like area of the cylindrical member 50′ such as to divide the interior of the latter into a first compartment 54′ and a second compartment 56′. Each of the first and second compartments 54′ and 56′, respectively, preferably contain a suitable amount, for purpose yet to be described, of a material 58′ which has the functional attributes of a wick. To this end, the material 58′ preferably is identical in all respects to the material 58 that has been described hereinbefore in connection with the discussion of the structure depicted in FIG. 3. Accordingly, it is not deemed necessary to set forth at this point by way of reiteration a detailed description of the nature of the material 58′. Further, as was briefly mentioned previously herein, the form of construction depicted in FIG. 4, i.e., the placement of the material 58′ in both of the compartments 54′ and 56′ is partiicularly suitable for use in those applications wherein a need exists to effect a cooling of both the interior and exterior surfaces of the tube 40′ including the tip 30′ thereof.

Continuing, in accord with the form thereof which is shown in FIG. 4 of the drawing, the divider means 52′ comprises a cylindrically configured member 68 that is of lesser diameter than the cylindrical member 50′ and which is positioned within the chamber-like area of the latter so as to be concentric with the tube 40′. Further, as best seen with reference to FIG. 4, the cylindrical member 68 is of double wall construction such that a chamber exists therewithin. Lastly, preferably the cylindrical member 68 is perforated substantially throughout.

Completing the description of the nature of the construction of the nozzle assembly 28′, a suitable amount of coolant fluid is provided within the cylindrical member 50′. There is also established within a heat pipe cooling means 48′ a flow path for the coolant fluid. Further, the heat pipe cooling means 48′ is provided with a suitable form of heat dissipating means 60′. Although the heat dissipating means 60′ may take several forms, in accord with the illustrated embodiment of the heat pipe cooling means 48′ the heat dissipating means 60′ consists of a member embodying a multiplicity of fin-like segments which is suitably mounted in surrounding relation to the exterior surface of the cylindrical member 50′ such that the fin-like segments of the former extend outwardly in a radial direction from the latter. As regards the other forms which the heat dissipating means 60′ may embody, they are the same as those to which reference was had hereinbefore in connection with the discussion of the heat dissipating means 60 of FIG. 3. To this end, any of these alternative forms of construction mentioned in connection with the heat dissipating means 60 of FIG. 3 are suitable for employment as the heat dissipating means 60′ of FIG. 5.

Finally, in accord with the illustration of FIGS. 4 and 5, the fluid flow path with which the heat pipe cooling means 48 is provided encompasses the reservoir 62′ and the inlet and outlet pipes 66′ and 64′, respectively, that are cooperatively associated with the reservoir 62′. Like the reservoir 62 with which the heat pipe cooling means 48 of FIG. 3 is provided, the reservoir 62′ is intended to serve primarily as a source of makeup fluid, and is not required for purposes of providing a head for the coolant fluid that flows through the heat pipe cooling means 48′. However, when employed, and as illustrated in FIGS. 5 and 3, the reservoirs 62′ and 62, respectively, preferably each contain a suitable amount of material 58′ and 58, respectively. Also, the inlet and outlet pipes 66′ and 64′, respectively, are each provided with a suitable amount of the material 58′ in the case of the heat pipe cooling means 48′ of FIGS. 4 and 5, while the inlet and outlet pipes 66 and 64, respectively, in similar fashion are provided with a suitable amount of the material 58 in the case of the heat pipe cooling means 48 of FIG. 3. The function of the material 58 that is placed within the reservoir 62 and the inlet and outlet pipes 66 and 64, respectively, is to enable the passage of the coolant fluid therethrough to be effected by means of capillary action. Likewise, the material 58' performs the same function in the case of the reservoir 62' and the inlet and outlet pipes 66' and 64', respectively.

For some applications, it may be deemed desirable to employ a passive pump at the condenser end of the heat pipe cooling means. Such a passive pump, denoted by the reference numeral 70, is illustrated in FIG. 5 of the drawing. The primary function of the passive pump 70 is to assist in the recirculation and the otherwise removal of the condensate from the condenser end of the heat pipe cooling means 48'. As will be set forth more fully hereinafter in connection with a description of the mode of operation of the heat pipe cooling means 48' of FIGS. 4 and 5, at the condenser end of the heat pipe cooling means 48' the coolant fluid which has previously been vaporized is now cooled through the action of the heat dissipating means 60' such that the vapor condenses. It is this condensate which the passive pump 70 is designed to remove.

Continuing with a description of the passive pump 70 of FIG. 5, as depicted therein the pump 70 is in the form of converging walls. However, there exists other applications wherein the passive pump 70 may be in the form of a structure wherein the walls diverge. More specifically, in those instances wherein the nozzle assembly 28 or 28' is constructed of materials which are selected to be hydrophilic, i.e., wetting, a passive pump 70 embodying converging walls is preferably employed. On the other hand, when the nozzle assembly 28 or 28' is constructed of materials selected to be non-wetting, i.e., hydrophobic, a passive pump 70 having walls that diverge in the direction of coolant flow is preferably used. Finally, a passive pump may also be utilized for purposes of establishing a desired direction of coolant flow in the case of a heat pipe cooling means that is provided with a reservoir.

Insofar as concerns the mode of operation of the nozzle assembly 28' of FIGS. 4 and 5, the mode of operation thereof is substantially the same as that of the nozzle assembly 28 of FIG. 3. One major difference therebetween, however, resides in the fact that whereas in the case of the nozzle assembly 28 of FIG. 3, the coolant fluid, i.e., water, flows in the form of a liquid through the first compartment 54 from one end thereof to the other by capillary action, and then after being vaporized returns to the condenser end of the heat pipe cooling means 48 in the form of a vapor by flowing through the second compartment 56 from one end thereof to the other, in the case of the nozzle assembly 28' of FIGS. 4 and 5, the coolant fluid, i.e., water, flows in the form of a liquid by capillary action simultaneously through both the first compartment 54' and the second compartment 56' from one end thereof to the other, and after becoming vaporized returns to the condensor end of the heat pipe cooling means 48' by passing through the perforations provided for this purpose in the cylindrical member 68 and flowing the length of the chamber that exists within the cylindrical member 68 whereupon the vapor passes through the perforations adjacent the other end of the cylindrical member 68, is cooled through the action of the heat dissipating means 60', condenses, and in the form of a liquid flows into the reservoir 62' through the inlet pipe 66'. Thereafter, the coolant fluid, i.e., water, in the form of a liquid leaves the reservoir 62' by means of the outlet pipe 64', enters the first and second compartments 54' and 56', respectively, and recommences its flow along the fluid flow path that is established therefor in the heat pipe cooling means 48'. A further difference between the nozzle assembly 28 as illustrated in FIG. 3 and the nozzle assembly 28' as depicted in FIGS. 4 and 5 resides in the fact that the latter includes a passive pump 70 which as has been described previously herein is intended to be operative for purposes of assisting the recirculation and otherwise removal of condensate from the condenser end of the nozzle assembly 28'.

Summarizing, the following concepts are encompassed within the subject matter of the present invention. First, the general concept of a heat pipe cooling means being arranged to wrap around a nozzle, in the manner that is illustrated in FIG. 3 and described herein, so as to effect a cooling of the exterior surface of the nozzle including the nozzle tip. Secondly, the concept of placing the wick-like material of the heat pipe cooling means in the compartment thereof that is located immediately adjacent to the bore of the nozzle so that a cooling at the interior surface of the nozzle including the nozzle tip can be effected. Thirdly, the concept of providing a heat pipe cooling means wherein, in the manner that is illustrated in FIGS. 4 and 5 and described herein, the wick-like material is provided immediately adjacent to the interior wall, i.e., bore, of the nozzle as well as immediately adjacent to the outermost, i.e., exterior surface, of the nozzle, and such that the wick-like material is joined, i.e., comes together, at the nozzle tip, but is separated along the axis, i.e., length, of the nozzle by two concentric perforated tubes or cylindrical screens that are suitably arranged so as to provide an annular space therebetween extending axially along the length of the nozzle for purposes of accommodating the flow of vapor to the condenser end of the nozzle assembly, all of which has the combined effect of providing a cooling of both the interior and the exterior surfaces of the nozzle including the tip portion thereof. Fourthly, whether the heat pipe cooling means embodies a form of construction suitable for effecting the cooling of the exterior surface of the nozzle, or one suitable for effecting a cooling of the interior surface of the nozzle, or one suitable for effecting a cooling of both the interior and the exterior surfaces of the nozzle, the concept of effecting a cooling of the condenser end of the heat pipe cooling means by means of the radiative action of passive heat transfer elements, e.g., fin-like metal segments or expanded metal, or by means of an active circulating loop through which a suitable coolant such as water is made to flow whereby the cooling action provided by either the passive system or the active system is sufficient to effect a condensing of the vapor when it reaches the condenser end of the heat pipe cooling means. Fifth, whether the heat pipe cooling means is intended to be operative for purposes of effecting a cooling of the exterior surface, or the interior surface, or both the exterior and the interior surfaces of the nozzle, the concept of providing at the condenser end of the heat pipe cooling means a passive pump, the function of which is to assist in the recirculation and otherwise in the removal of the coolant condensate from the condenser end of the heat pipe cooling means to the reservoir and/or the evaporator end of the heat pipe cooling means, and embodying a form of construction wherein a condensing nozzle is provided thereby which alternatively can be made to either converge in the direction of condensate flow if the condensing nozzle is wetted, i.e., hydrophilic, relative to the coolant, or diverging if the condensing nozzle is or is largely non-wetted, i.e., hydrophobic, relative to the coolant so as to pinch or restrict the condensed coolant discharge passageway from the cavity area in which the wick-like material is emplaced if wetted, or so as to expand the area of the circular passageway if the latter is formed of non-wetted materials. Sixth, the concept whereby the materials of which the nozzle assembly equipped with heat pipe cooling means is constructed are selected so as to themselves be or to have coatings applied thereto which are either wetting or non-wetting relative to the coolant so as to promote effective and efficient cooling action by the heat pipe cooling means. In particular, that the perforated tubes or screens where used for purposes of isolating, in the manner depicted in FIGS. 4 and 5, the coolant liquid from the coolant vapor be non-wetting, i.e., hydrophobic, with respect to the coolant whether the latter be water or some other coolant; that the innermost surfaces of the inner and the outer envelope walls of the nozzle be of a material or be coated with a material which is wetted, i.e., hydrophilic, relative to the coolant whether the latter be water or some other coolant; and that the coolant reservoir, if employed, be of or be coated with a material which is not or essentially is not wetted by the coolant. Seventh, the concept that in the event that a coolant reservoir is utilized, that it be established whether the coolant supplied to/from the reservoir always flows in one direction and if this is so established that a passive pump be emplaced in the fluid flow path between the reservoir and the coolant flow passageway from which the condensed coolant is discharged so as to be operative to assist in pumping the coolant towards the evaporator end of the heat pipe cooling means.

In accordance with the present invention there has thus been provided a new and improved nozzle that is equipped with means operative for effecting a cooling of the nozzle. Moreover, the means which the nozzle of the present invention embodies for effecting the cooling thereof comprises heat pipe cooling means. In addition, in accord with the present invention a nozzle equipped with heat pipe cooling means is provided which avoids the problems that are occasioned by the presence of water-borne chemical deposits, particulates and scaling. Further, the nozzle equipped with heat pipe cooling means of the present invention is operative as a self-contained unit thus eliminating the requirement for employing externally located valves, filters, manifolds, pumps, etc. Additionally, in accordance with the present invention a nozzle equipped with heat pipe cooling means is provided that inherently minimizes the possibility for the development of hot spots. Also, the nozzle eqiupped with heat pipe cooling means of the present invention does not make use of an on-off mode which in the event of a power loss could cause component failure, etc. Furthermore, in accord with the present invention a nozzle equipped with heat pipe cooling means is provided that is advantageously characterized in that it is relatively inexpensive to produce, yet despite being relatively simple in construction is capable of providing reliable operation.

While two embodiments of my invention have been shown, it will be appreciated that other modifications thereof, some of which such as the omission of the reservoir 62, the employment of a passive pump 70, the use of wetted or non-wetted materials, etc. have either been explicitly mentioned or alluded to hereinabove, may still be readily made thereto by those skilled in the art. I, therefore, intend by the appended claims to cover the modifications explicitly mentioned or alluded to herein as well as all other modifications, which fall within the true spirit and scope of my invention.

What is claimed is:

1. In an apparatus embodying a combustion chamber, a nozzle assembly including a hollow member having one end thereof in fluid flow communication with the interior of the combustion chamber, the nozzle assembly being operative to effect the conveyance therethrough as well as the introduction therefrom into the combustion chamber of one of the substances that is required in order to support combustion within the combustion chamber, the improvement comprising heat pipe means operative to effect cooling of the hollow member, said heat pipe means including a member having an evaporator end and a condenser end, said member being mounted in concentric relation to the hollow member, said member including a first wall surface, a second wall surface and a divider wall surface, said first wall surface supported in abutting relation to the exterior of the hollow member, said first wall surface having a length less than the length of the hollow member, said second wall surface extending in parallel relation to said first wall surface and having a length less than the length of said first wall surface, said first wall surface being joined to said second wall surface at said evaporator end of said member, said divider wall surface being perforated for a portion of the length thereof and extending in parallel relation to both said first wall surface and said second wall surface, said divider wall surface having a length less than the length of said first wall surface, said divider wall surface being joined to said first wall sufface at said condenser end of said member and being joined to said second wall surface at a point intermediate the length of said divider wall surface, said divider wall surface being operative to divide said member into a first chamber located between said divider wall surface and said first wall surface and a second chamber located between said divider wall surface and said second wall surface, said heat pipe means further including wick-like material located within said second chamber and at said evaporator end of said member, said heat pipe means also including a reservoir, an inlet pipe and an outlet pipe, said reservoir being located externally of said member, said inlet pipe having one end thereof connected in fluid flow relation to said reservoir and the other end thereof connected in fluid flow relation to said first chamber at said condenser end of said member, said outlet pipe having one end thereof connected in fluid flow relation to said reservoir and the other end thereof connected in fluid flow relation to said second chamber adjacent the point of joinder of said second wall surface to said divider wall surface, said heat pipe means further including heat-dissipating means including a multiplicity of fin-like members mounted on the exterior of said divider wall surface intermediate said inlet pipe and said outlet pipe, said multiplicity of fin-like members being mounted so as to extend outwardly in a radial direction from said divider wall surface, said heat pipe means containing a supply of coolant fluid and having a fluid flow path established therewithin for said coolant fluid, said wick-like material being operative to cause said coolant fluid to flow as a liquid by capillary action through said second chamber along said fluid flow path from said condenser end to said evaporator end of said member, at said evaporator end said coolant fluid absorbing heat from the combustion chamber so as to become vaporized, as vapor said coolant fluid flowing through said first chamber along said fluid flow path from said evaporator end to said condenser end of said member, at said condenser end said coolant fluid being cooled so as to condense, at said condenser end said coolant fluid flowing from said first chamber through said inlet pipe to said reservoir and through said reservoir to said outlet pipe and from said outlet pipe into said second chamber, said coolant fluid being continuously circulated through said second chamber and said first chamber so as to thereby effect a cooling of the hollow member that is surrounded by said heat pipe means.

2. In an apparatus, the heat pipe means as set forth in claim 1 wherein at least some of the materials employed in the construction of said heat pipe means are hydrophilic relative to said coolant fluid.

3. In an apparatus, the heat pipe means as set forth in claim 1 wherein at least some of the materials employed in the construction of said heat pipe means are hydrophobic relative to said coolant fluid.

* * * * *